United States Patent [19]

Fleischmann et al.

[11] Patent Number: 5,051,060

[45] Date of Patent: Sep. 24, 1991

[54] GAS FRICTION PUMP HAVING AN OUTLET-SIDE HELICAL STAGE

[75] Inventors: Frank Fleischmann, Bergheim-Glessen; Hans-Peter Kabelitz, Cologne; Hans Kriechel, Bornheim; Martin Mühlhoff, Colonge, all of Fed. Rep. of Germany

[73] Assignee: Leybold Aktiengesellschaft, Cologne, Fed. Rep. of Germany

[21] Appl. No.: 554,721

[22] Filed: Jul. 19, 1990

[30] Foreign Application Priority Data

Jul. 20, 1989 [EP] European Pat. Off. ..... 89113318.3

[51] Int. Cl.[5] ..... F01D 1/00

[52] U.S. Cl. ..... 415/90; 415/914; 417/366

[58] Field of Search ..... 415/90, 914, 201, 169.1, 415/121.3, 110; 417/366, 368, 423.9, 424.1, 423.14, 423.4, 431, 160

[56] References Cited

U.S. PATENT DOCUMENTS

| | | | |
|---|---|---|---|
| 4,273,263 | 6/1981 | Voegele et al. | 417/431 |
| 4,734,018 | 3/1988 | Taniyama et al. | 417/366 |
| 4,806,074 | 2/1989 | Bürger et al. | 415/90 |

FOREIGN PATENT DOCUMENTS

| | | | |
|---|---|---|---|
| 0056987 | 3/1989 | Japan | 415/90 |

*Primary Examiner*—Edward K. Look
*Assistant Examiner*—Hoang Nguyen
*Attorney, Agent, or Firm*—Spencer & Frank

[57] ABSTRACT

A gas friction pump has an inlet arranged to be coupled to a vessel to be evacuated; an outlet and an outlet-side pumping stage formed of a helical gas pumping channel. The pump further has a scavenging gas inlet circumferentially surrounding the helical gas pumping channel for exposing the channel to a scavenging gas.

8 Claims, 2 Drawing Sheets

GAS FRICTION PUMP HAVING AN OUTLET-SIDE HELICAL STAGE

CROSS REFERENCE TO RELATED APPLICATION

This application claims the priority of European Application No. 89113318.3 filed July 20th, 1989, which is incorporated herein by reference.

BACKGROUND OF THE INVENTION

The invention relates to a gas friction pump having at least one outlet-side helical stage formed of an annular, helically extending gas delivery (gas pumping) channel.

Friction pumps encompass molecular and turbomolecular vacuum pumps. In molecular pumps a movable rotor wall and an immobile stator wall are so configured and so spaced from one another that the pulses imparted by the walls to the gas molecules situated between the walls have a predetermined, preferred direction. For this purpose, as a rule, the rotor and/or stator wall is provided with helically extending (thread or screw-like) depressions or ribs. Turbomolecular pumps have interengaging stator and rotor wheel series, similarly to a turbine; they need a pre-vacuum pressure of approximately $10^{-2}$ mbar. In contrast, molecular pumps deliver at pressures of 10 mbar and above so that the arrangement required for producing the pre-vacuum is much simpler.

Friction pumps of the above-outlined type, such as disclosed, for example, in German Offenlegungsschrift 3,705,912 are frequently used for evacuating vessels in which etching, coating or other vacuum treatments or manufacturing processes are performed. These processes involve the risk that solid particles may gain access to the pumps. In some processes such solid particles may come into being only during the compression of the gases, that is, during the passage of the pumped gas through the vacuum chamber. As an example there is mentioned the formation of aluminum chloride in case of aluminum etching or ammonium chloride in case of coating processes.

In case solid particles of the above-outlined type settle in the gas pumping channels of the vacuum pump, the diameter of the channels is reduced which results in a decrease of the output of the vacuum pump. Precisely in case of friction pumps which are, at least in the outlet-side zone, designed as molecular pumps, it has been found that undesired solid particles settle on the helical channel structure in the vicinity of the pump outlet.

It is a further risk that dust-like solid particles may gain access to the motor chamber which also accommodates bearings. Generally, these bearings are lubricated roller bearings which are exposed to an increased wear when dust is present.

In friction pumps which are utilized in the aboveoutlined pumping processes, an increased maintenance is necessary for the reasons stated. The removal of dirt from the gas pumping channels and the motor chamber necessitates a disassembly of the pump which is a complex operation, it causes a significant down time and therefore involves substantial expense.

Further, in helical pump stages, usually in the final pressure zone, reverse molecular and/or oil flows occur. These occurrences take place because there is practically no more molecular flow in the pumping direction and the optically free cross section of the helical channels is relatively large. Particularly in the final pressure operation gas circuits are generated in the helical stages. In the zone of the rotor wall the few, still-present molecules flow in the direction of gas pumping. In the zone of the bottom of the helical turns these gases flow in a reverse direction and cause a reverse oil flow. Therefore the risks are substantial that the oil molecules originating from the pre-vacuum pump gain access to the recipient vessel and thus adversely affect the process performed therein. Particularly in the manufacture of semiconductor components even the smallest amounts of oil vapor concentrations may prove to be extremely harmful.

SUMMARY OF THE INVENTION

It is an object of the invention to provide an improved gas friction vacuum pump of the above-outlined type in which, on the one hand, dust deposits in the outlet-side zone are eliminated and/or can be avoided and, on the other hand, the risk of contaminating the work chamber coupled to the pump with oil vapors no longer exists.

This object and others to become apparent as the specification progresses, are accomplished by the invention, according to which, briefly stated, the pump is provided with a scavenging gas inlet which extends over the circumference of the gas delivery channel.

In a pump which incorporates the invention as outlined above, by virtue of introducing blasts of a scavenging gas (preferably nitrogen) of an order of magnitude of 100 mbar 1/s during operational rpm's, there is achieved a powerful rinsing (scavenging) of the zones situated downstream of the scavenging gas inlet, that is, particularly in the critical stages in the vicinity of the pump outlet. By repeating the process in appropriate intervals, the deposited dust maY be removed. A continuous introduction of scavenging gas at a few (1–5) mbar 1/s, preferably during the final pressure operating phase, a sufficient molecular flow is achieved in the direction of pumping so that a partial reverse flow and thus a reverse oil flow is avoided.

It is particularly advantageous to provide a sharp edge which is exposed to the high-speed scavenging gas and which forms the outlet-side boundary of the inlet opening of the scavenging gas in the gas pumping channel. In this manner there is obtained a "streaming wall" which stops reverse oil flows and forwards the oil molecules to the outlet.

DESCRIPTION OF THE PREFERRED EMBODIMENT

Figure 1:
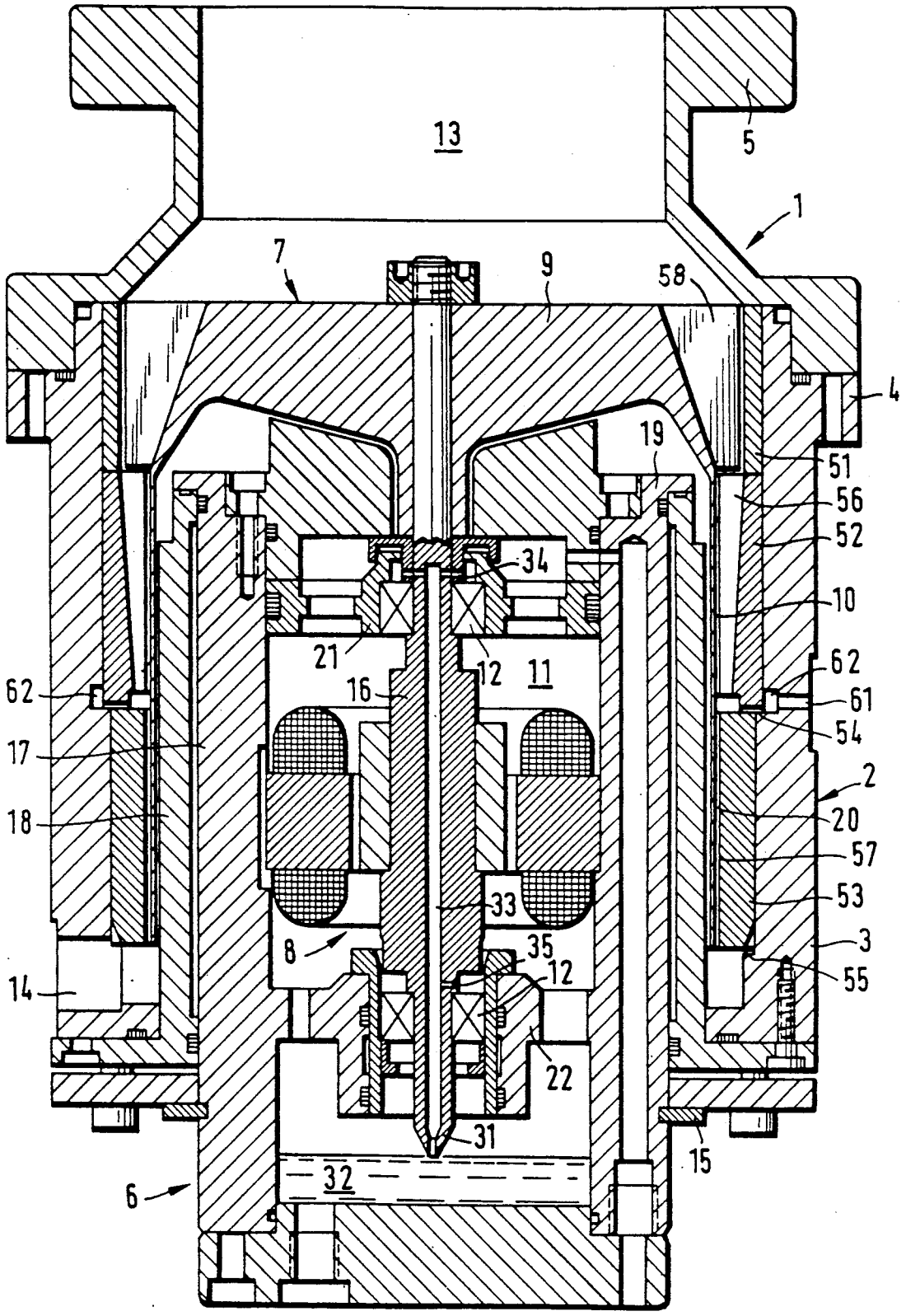
FIG. 1 is an axial sectional view of a preferred embodiment of the invention.

The friction pump 1 illustrated in FIG. 1 has a first housing portion 2 which includes an outer cylinder 3 having a flange 4. The friction pump 1 is, with the aid of the flange 4, tightened either directly or with the intermediary of an adaptor flange 5 to the vessel to be evacuated.

The friction pump 1 has a second housing portion 6 which serves for supporting a rotor 7 and a stator of the drive motor 8. The rotor 7 is bell-shaped and it includes a hub portion 9 and a cylindrical shell portion 10. The housing portion 6 projects into the inner space 11 which is defined by the bell-shaped rotor 7 and in which there are further accommodated the drive motor 8 and at least the upper bearing of the two rotor bearings 12. The external face of the rotor 7 forms, together with the inner face of the outer cylinder 3, the active pumping faces, that is, the annular gas delivery channel 20. The gases to be pumped are delivered from the inlet 13 to the outlet 14. During operation a nonillustrated prevacuum pump is coupled to the outlet 14.

The two housing portions 2 and 6 are designed such that they may be separated and reassembled in a simple manner. The mutual immobilization in the assembled state is effected by a clamping ring 15.

The rotor 7 has a central shaft 16 which is supported in the bearings 12 which, in turn, engage, with the intermediary of annular discs 21 and 22, a cylindrical part 17 which forms a component of the housing portion 6.

The housing portion 2 has an inner cylindrical part 18 which surrounds the cylindrical part 17 of the housing portion 6. The cylindrical part 17 has an edge 19 which lies on the upper end face of the cylindrical part 18. The cylindrical part 17 projects downwardly beyond the cylindrical part 18, that is, beyond the housing portion 2 so that both housing portions 2 and 6 may be immobilized with respect to one another by means of the clamping ring 15. After releasing the clamping ring 15, the unit formed by the rotor 7 and the housing portion 6 may be upwardly removed from the housing portion 2.

A lubricant supply arrangement for the bearings 12 of the shaft 16 is accommodated within the space 11 which is outwardly tightly sealed and which is defined by the rotor 7 and the housing portion 6. The shaft 16 extends with a lower conical portion 31 into an oil sump 32 and has a central oil channel 33. The oil rising in the central channel 33 is ejected through the lateral ports 34 and 35 onto the bearings 12 by centrifugal forces.

The cylindrical shell portion 10 of the rotor 7 has a relatively thin wall whereby the rotating mass is maintained small. The helical channel structure providing for a delivery of the gases forms a component of the stator. In the cylindrical housing 3 there are provided rings 51, 52 and 53 which are supported on radially inwardly extending shoulders 54 and 55 in the housing 3. The two rings 52 and 53 are provided on their inner sides with helical channel structures 56 and 57. These structures, together with the outer surface of the cylindrical portion 10 of the rotor 7 provide for a delivery of the gases in the direction of the outlet 14. With the aid of the adaptor flange 5 the rings 51, 52 and 53 are held together firmly in their assembled state. After releasing the adaptor flange 5, first the unit formed of the rotor 7 and the housing portion 6 and thereafter the rings 51, 52 and 53 may be lifted out of the housing portion 3.

The ring 51 has a smooth inner surface. The structures 58 effecting the delivery of gases are provided on the rotor itself. They may be designed in a manner disclosed in European Patent Application 88116749.8. These structures are designed as webs whose width and pitch decrease from the suction side to the pressure side. In this manner there is obtained an effective charging stage 51, 58 with an improved output.

The cylindrical housing 3 has a radial port 61 to which a non-illustrated scavenging gas conduit may be connected. The port 61 merges into an annular channel 62 in which the scavenging gas is collected so that it may be introduced uniformly over the entire circumference of the gas delivery channel 20.

Figure 2:
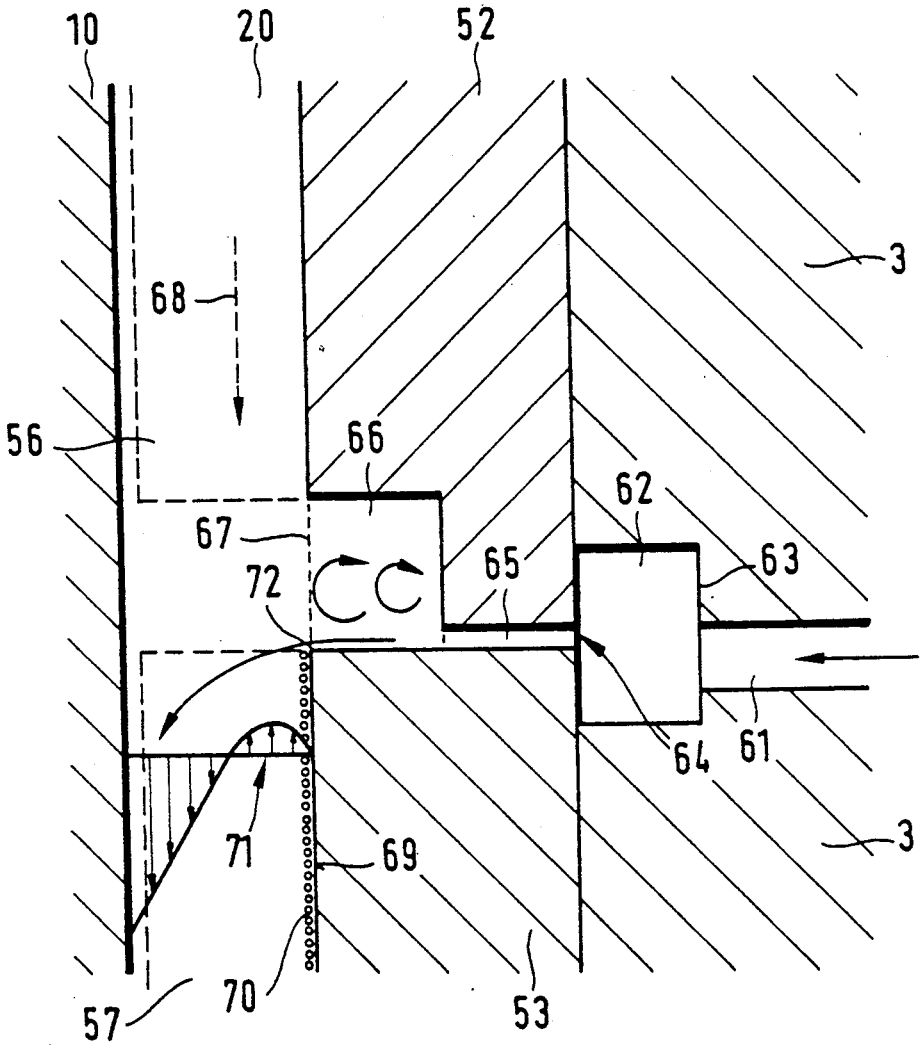
FIG. 2 is an enlarged axial sectional detail of the structure shown in FIG. 1.

FIG. 2 illustrates the zone of the scavenging gas inlet on a significantly magnified scale. This Figure shows that the scavenging gas introduction is effected between the two helical, axially adjoining stage rings 52 and 53. The collecting channel 62 is formed by an inner groove 63 in the housing portion 3. In the zone of abutment 64 between the two rings 52, 53, one of these rings is provided with radially extending grooves or a knurling whereby a passage gap 65 is obtained which extends over the entire inner pump circumference. The gap 65 is adjoined by an enlarged annular space 66 which is formed by undercutting the lower edge of the ring 52 and its helical structure 56. In this manner there is obtained an inlet opening 67 which is enlarged with respect to the passage clearance 65 and which extends over the entire circumference of the gas delivery channel 20.

During operation of the friction pump 1 equipped with a scavenging gas inlet according to the invention, the pumped gas molecules move in the annular gas supply channel 20 in the direction of the arrow 68. The scavenging gas enters through the port 61 into the annular channel 62 and is distributed over the circumference of the pump. Thereafter, the scavenging gas enters at a high speed through the clearance 65 into the enlarged space 66 in which the ga is partially quieted. Since such a quieting is possible only towards the inlet side, the flow velocity of the scavenging gas is maintained along the end face of the ring 53. In this manner, there is obtained a "streaming wall" which effectively retains not only the oil 70 which creeps in the bottom 69 of the helical channel in the direction of the inlet, but also the reverse molecular flows in the channel bottom, symbolized by the arrows 71. The molecules entrained by the scavenging gas are delivered in the direction of the outlet. A sharp-edged design of the transition 72 of the helical channel bottom 69 to the inlet-side end face of the ring 53 enhances the desired effect.

It will be understood that the above description of the present invention is susceptible to various modifications, changes and adaptations, and the same are intended to be comprehended within the meaning and range of equivalents of the appended claims.

What is claimed is:

1. In a gas friction pump having an inlet arranged to be coupled to a vessel to be evacuated; an outlet and an outlet-side pumping stage formed of a helical gas pumping channel, the improvement comprising a scavenging gas inlet means for exposing the channel to a scavenging gas; said scavenging gas inlet means including means defining an inlet port and means defining an annular collecting channel circumferentially surrounding the gas pumping channel and communicating with said inlet port.

2. A gas friction pump as defined in claim 1, further comprising a stationary annular pump component circumferentially surrounding the channel; said scavenging gas inlet means including an inlet passage bounded by the component and having an outlet end merging into the channel; and a sharp edge formed on the component and bounding said outlet end.

3. A gas friction pump as defined in claim 1, wherein said scavenging gas inlet means includes means defining an annular passage gap surrounded by the annular collecting channel and being in communication therewith.

4. A gas friction pump as defined in claim 3, wherein said scavenging gas inlet means includes means defining an annular quieting chamber surrounded by the annular passage gap and being in communication therewith.

5. In a gas friction pump having an inlet arranged to be coupled to a vessel to be evacuated an outlet and an outlet-side pumping stage, the improvement comprising means defining two axially adjoining helical pumping channels forming said outlet-side pumping stage; and a scavenging gas inlet means circumferentially surrounding the helical gas pumping channels for exposing the channels to a scavenging gas; said scavenging gas inlet means being disposed in a zone where the helical pumping channels join one another.

6. A gas friction pump as defined in claim 5, wherein said means defining the two pumping channels comprise two axially adjoining, aligned stationary rings.

7. A gas friction pump as defined in claim 6, wherein said scavenging gas inlet means includes a flow passage defined together by the two axially adjoining stationary rings.

8. A gas friction pump as defined in claim 7, wherein said two axially adjoining stationary rings are in an abutting relationship with one another with respective radial faces; one of said radial faces being provided with a knurling for defining said flow passage.

* * * * *